United States Patent [19]

Swift et al.

[11] Patent Number: 4,684,874

[45] Date of Patent: Aug. 4, 1987

[54] RADIAL WAVE POWER DIVIDER/COMBINER AND RELATED METHOD

[75] Inventors: Gerald W. Swift, Rolling Hills Estates; David I. Stones, Torrance, both of Calif.

[73] Assignee: TRW Inc., Redondo Beach, Calif.

[21] Appl. No.: 698,296

[22] Filed: Feb. 5, 1985

[51] Int. Cl.[4] ..... H01P 5/12

[52] U.S. Cl. ..... 333/125; 333/208

[58] Field of Search ..... 333/125–127, 333/134–137, 208, 212; 330/286, 287; 331/56

[56] References Cited

U.S. PATENT DOCUMENTS

| | | | |
|---|---|---|---|
| 2,747,184 | 5/1956 | Kock | 333/208 X |
| 2,943,280 | 6/1960 | Brill | 333/208 |
| 3,156,879 | 11/1964 | Hess | 333/136 |
| 3,582,813 | 6/1971 | Hines | 331/56 |
| 4,559,490 | 12/1985 | Gannon et al. | 333/208 X |
| 4,562,409 | 12/1985 | Saito et al. | 333/137 X |

OTHER PUBLICATIONS

Thompson A. and Yelland J. V., "A Sixty-Way S-Band Radial Waveguide Combiner," paper presented at 14th European Microwave Conference, Sep. 10–13, 1984, pp. 335–340.

*Primary Examiner*—Paul Gensler

*Attorney, Agent, or Firm*—Robert M. Wallace; Noel F. Heal; Noel F. Stern

[57] ABSTRACT

A microwave radial power divider/combiner device having desirably broad bandwidth response over a selected frequency range. The device includes a radial waveguide that has a number of adjoining annular sections, each of selected rádial length and axial height, to provide lumped circuit parameters closely euqivalent to those of an ideal filter with the desired passband characteristics. The ideal filter is first designed using conventional synthesis techniques, then modified, if necessary, to allow its realization in radial waveguide form. The waveguide sections are selected to have lengths and uniform heights to approximate the lumped circuit parameters of the filter, and the dimensions are then optimized to provide the closest approach to the desired performance characteristics.

5 Claims, 4 Drawing Figures

RADIAL WAVE POWER DIVIDER/COMBINER AND RELATED METHOD

BACKGROUND OF THE INVENTION

This invention relates generally to microwave power combiners and power dividers, and more particularly, to microwave combiners and dividers of radial configuration. The term "microwave" is generally applied to electro-magnetic signals and devices operating in the frequency range from 300 MHz (megahertz) to 300 GHz (gigahertz). To obtain high powers at high frequencies, the outputs of multiple oscillator or amplifier devices must be combined. There is, therefore, a need for microwave power combiner operable over a wide band of frequencies and capable of handling high powers. Other applications, such as phased-array antennas, require a power dividing function, in which a single high-power radio-frequency (rf) input signal is to be split into a number of output signals, usually of equal but smaller powers.

Various configurations have been proposed to provide the power combining or dividing function, including Kurokawa-type combiners, magic-tee hybrid couplers and microstrip power dividers or combiners. The Kurokawa device is basically a cavity to which is coupled a number of coaxial waveguides providing separate power inputs, such as from IMPATT diodes (employing impact-ionization avalanche transit-time properties). Although power combiner devices of this type are satisfactory for some applications, their chief limitation is a relatively narrow bandwidth, arising from their resonant nature. Magic tee or hybrid couplers have good bandwidth characteristics but are usually limited to four or eight input sources. Moreover, they have high losses at millimeter-wave frequencies (above 30 GHz). Similarly, microstrip combiners or dividers have high losses at high frequencies and are, therefore, incapable of handling high powers at these frequencies.

Radial line combiners using microstrip structuress have been disclosed in U.S. Pat. Nos. 4,371,845 to Pitzalis, Jr. 4,234,854 to Cohn et al., and 4,032,865 to Harp et al. Other attempts to produce a wideband non-resonant power combiner structure include a so-called radial line combiner disclosed in U.S. Pat. No. 3,582,813 to Hines, in which solid-state power-generating devices are disposed around a central coaxial output line, to which they are coupled. Another proposed solution to the problem is the conical power combiner disclosed in U.S. Pat. No. 4,188,590 to Harp et al. In a paper entitled "A 6-GHz GaAs FET Amplifier with TM-Mode Cavity Power Combiner," by Naofumi Okubo et al., 1983 IEEE MTT-S Digest, pp. 276-77, an improved frequency response is obtained by employing two radial cavities coupled together in a series stack, in an axial sense.

In all radial wave combiners or dividers, having a central port and multiple peripheral ports, a desired performance response is typically obtained by first loading the peripheral ports with a lossy material and matching the central port to conform with the characteristics of the radial waveguide. Then peripheral port matching is attempted, but the resulting complex impedence presented at the central port restricts the operating bandwidth of the device, and limits its performance.

In essence, the only prior-art approach to achieving a desired frequency response in a power combiner divider is largely an empirical one. In brief, the physical parameters of the device are modified until the desired characteristic is approached. Designing a combiner or divider with a broadband frequency response is particularly difficult and has long provided a challenge to designers of microwave devices.

It will be appreciated from the foregoing that there is a need for a more reliable approach to the design of radial microwave dividers or combiners. The present invention is directed to this end.

SUMMARY OF THE INVENTION

The present invention resides in a broadband radial microwave power divider or combiner, and in a related method for its design. The device of the invention has a very broad frequency response characteristic, which is selectable by design rather than by an empirical approach. It will be understood that the structure of the invention may be used as either a power combiner or a power divider, depending on the application of the device. Accordingly, the term divider/combiner will be used in some instances to describe the device.

Briefly, and in general terms, the power divider/combiner of the invention comprises a pair of circular, axially spaced waveguide plates defining a plurality of adjoining annular waveguide sections, each of which has parallel walls formed by the two waveguide plates and has a radial length and axial spacing optimally selected to provide a close equivalent of a desired lumped-parameter filter element. The device also includes a central port located at the center of the plates, and a plurality of peripheral ports uniformly spaced about a circular arc near the periphery of the plates. The annular waveguide sections together provide a desired wide passband characteristic at a selected frequency range.

The method of the invention includes the steps of first designing a lumped-parameter filter to provide a desired frequency response between a single input port and a plurality of output ports, then selecting the radial length and axial spacing of the waveguide plates in each annular waveguide section, to provide approximately the equivalent of the lumped circuit parameter for a corresponding one of each of the parameters in the filter circuit. Finally, the method includes optimizing the selected dimensions of the annular waveguide sections to approach as closely as possible the desired response characteristics.

By way of example, the lumped-parameter filter circuit might include a first shunt capacitance, a first series inductance, a second shunt capacitance, a second series inductance, and a shunt inductance. The circuit parameters of this filter would be chosen such that, if the filter were to be constructed, using actual capacitors and inductors, the filter would have the desired response characteristic.

Each lumped circuit parameter has a close equivalent in microwave transmission line form. For example, a short length of low-impedance transmission line is equivalent to a shunt capacitance, and a short length of high-impedance transmission line is equivalent to a series inductance. However, the invention relates to radial structures, which have the inherent property that the characteristic impedance of a waveguide section decreases as the radius increases. Consequently, to simulate a specific circuit parameter precisely with a radial waveguide section is not possible. One approximate solution is to employ a radial waveguide section in which the axial spacing, or height, increases with increasing radius. This would mean that at least one of the waveguide surfaces would have to be part-conical in shape. For reasons of manufacturing convenience, however, a uniform plate spacing is preferred in each waveguide section. In the disclosed method of the invention, conical or tapered waveguide sections are used to provide an initial approximation to the desired solution; then an optimized solution is developed using incremental waveguide sections of uniform, but different, heights or axial spacings. A large number of annular waveguide sections is impractical from a cost standpoint, and a satisfactory result can be obtained using as few as four or five sections. A first approximation of the height of each waveguide section can be obtained by selecting a height equal to the average height of the tapered or conical waveguide section that is approximately equivalent to the desired circuit parameter. Alternatively, an optimized solution can be obtained without consideration of the tapered or conical waveguide sections that represent an approximation. In the optimizing step, the response characteristics of the first-approximation waveguide are predicted, and the radial length and height of each section are adjusted to further improve the response characteristics.

It will be appreciated from the foregoing that the present invention represents a significant advance in the field of microwave power combiners and dividers. In particular, the invention provides a device with a desired response characteristic without having to rely on empirical methods of design. The resulting structure not only achieves an unusually broad frequency response, but it is of simple, two-piece construction and can be easily machined or cast at relatively low cost.

Other aspects and advantages of the invention will become apparent from the following more detailed description, taken in conjunction with the accompanying drawings.

BRIEF DESCRIPTION OF THE DRAWINGS

FIG. 2*b* is an equivalent circuit diagram of the divider/combiner of FIG. 2*a.

DESCRIPTION OF THE PREFERRED EMBODIMENT

Figure 2A:
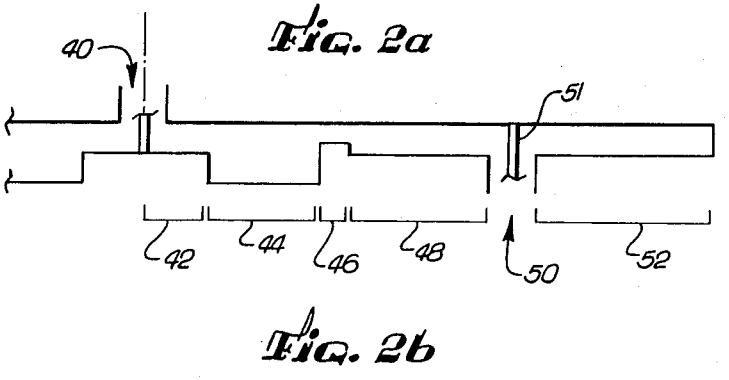
FIG. 2*a* is fragmentary simplified cross-sectional view taken along a radius of a microwave power divider/combiner constructed in accordance with the invention.

As shown in the drawings for purposes of illustration, the present invention is concerned with radial structures for combining or dividing microwave power signals. A radial divider/combiner comprises a pair of parallel circular plates, a center input or output port, and multiple peripheral ports. In the past it has proved very difficult to obtain a desired wide bandwidth response from such a device, especially at higher frequencies. Design has typically been accomplished by matching the center port of the device to the radial waveguide mode, and then adjusting the peripheral port configuration for best results. The resulting complex impedance presented at the center port restricts the operating bandwidth and limits the performance of the device.

Figure 1:
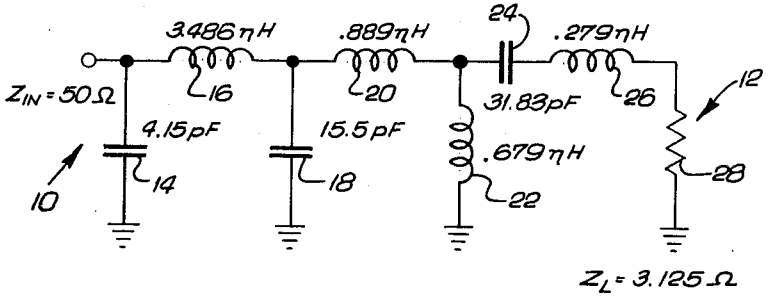
FIG. 1 is a circuit diagram of an exemplary lumped-parameter filter having a desired broad-band frequency response.

In accordance with the invention, a radial power divider/combiner is configured as a number of adjoining annular waveguide sections, each of which provides an impedance approximately equivalent to that of a lumped circuit parameter of a filter designed to yield the desired frequency response. In effect, the radial waveguide of the invention is synthesized to provide a desired response characteristic. The starting point in the design is the desired frequency response characteristic, and the first step in achieving the desired result is to employ a conventional filter synthesis program to formulate the design of a lumped-parameter filter having the desired response. One example of such a filter is shown in FIG. 1. The synthesized filter with the desired broadband response includes an input circuit, indicated by reference numeral 10 and an output circuit indicated by a reference in numeral 12. The desired characteristic input impedance is 50 ohms and desired characteristic output impedance is 3.125 ohms, or one-sixteenth of the input impedance. This relationship arises because the power divider is to have sixteen output ports, which will be connected in parallel.

The filter shown in FIG. 1 is derived from the exact solution of a sixth-order 0.1 dB ripple Chebyshev filter. The circuit includes a shunt capacitance 14 and a series inductance 16 connected to the input circuit 10, a second shunt capacitance 18 and a second series inductance 20, a shunt inductance 22, a series capacitance 24, and a third series inductance 26 is connected to the output circuit 12, shown by its characteristic impedance 28. This circuit can be derived using any of a number of available filter synthesis computer programs for the computer-aided design of filters. For example, FILSYN is such a program available from COMSAT General Integrated Systems Inc., of Palo Alto, Calif. 94303.

If all of the lumped circuit parameters of FIG. 1 could be realized in the form of a radial waveguide, the design could be completed by merely synthesizing such a device and including elements in the waveguide that are the equivalent of corresponding elements in FIG. 1. However, a series capacitance has no direct equivalent in a radial waveguide. A short length of low-impedance microwave transmission line is equivalent to a shunt capacitance, and a short length of high-impedance transmission line is equivalent to a series inductance. A shunt inductance can take the form of a shorted transmission line stub. Because a series capacitance has no direct microwave transmission line equivalent, the circuit of FIG. 1 cannot be used without modification.

Figure 2B:
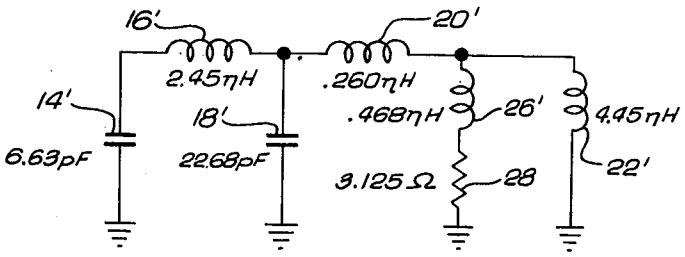

The modification arrived at is shown in FIG. 2*b*. Basically, the series capacitance 24 is eliminated, and the other impedances are modified, as indicated by primed reference numerals. The shunt inductance 22', series inductances 16', 20' and 26' and shunt capacitances 14' and 18' in general have different values from those of the corresponding components of FIG. 1. The transformation from the FIG. 1 circuit to the FIG. 2*b* circuit may be derived empirically. By way of example, the transformation may be made using a program package known as COMPACT, also available from COMSAT General Integration Systems Inc.

The circuit of FIG. 2*b* still represents a lumped-parameter filter, and not a radial waveguide. The final transformation to radial waveguide components is complicated by the geometry of the waveguide. As the radius increases, so does the area between the two plates of the waveguide, with a resulting decrease in characteristic impedance. An approximation of a lumped circuit parameter may be made by means of a waveguide section in which the spacing between the plates increases with increasing radius. This would mean that at least one of the plates would have to have a part-conical shape. However, fabrication of a waveguide with tapered sections presents some practical problems. From a manufacturing standpoint, a radial waveguide should have parallel plates, and this is one of the goals of the invention.

In the structure of the invention, each circuit parameter in FIG. 2*b* is represented in a radial waveguide by an annular waveguide section, as shown in FIG. 2*a*. A central input port 40 provides for the input of microwave energy to the waveguide, and the first shunt capacitance 14' is represented by a first waveguide section 42 at the center of the device. The first series inductance 16' is represented by a second waveguide section 44 adjoining the first and having a larger plate spacing. Then the second shunt capacitance 18' is represented by a third waveguide section 46, having a reduced spacing and much shorter length than the first two sections. The second series inductance 20' is represented by a fourth waveguide section 48, extending to a plurality of peripheral output ports 50, only one of which is shown in the drawings. The shunt inductance 26' is represented by the inductance of a probe 51 associated with each peripheral port 50. Finally, the shunt inductor 22' is represented by a further radial extension of the waveguide, indicated by the peripheral waveguide section 52, which functions as a backshort section.

As a first approximation, each section of the waveguide is selected to have a fixed spacing or height dimension that is the average spacing of the approximately optimum "conical" waveguide section, and the same radial length as the conical waveguide section. This approximation provides a reasonably good response characteristic, but further improvement is still highly desirable. Using conventional optimization techniques, the length and spacing, or height of each waveguide section can be optimized to yield much more desirable characteristics. By way of example, an optimization program for this purpose is provided as Appendix A to this specification.

Using the dimensions of conical waveguide sections as a starting point in the optimization process is not an essential element of the invention. With an appropriate optimization program, consideration of the conical waveguide solution could be completely omitted from the procedure.

Figure 3:
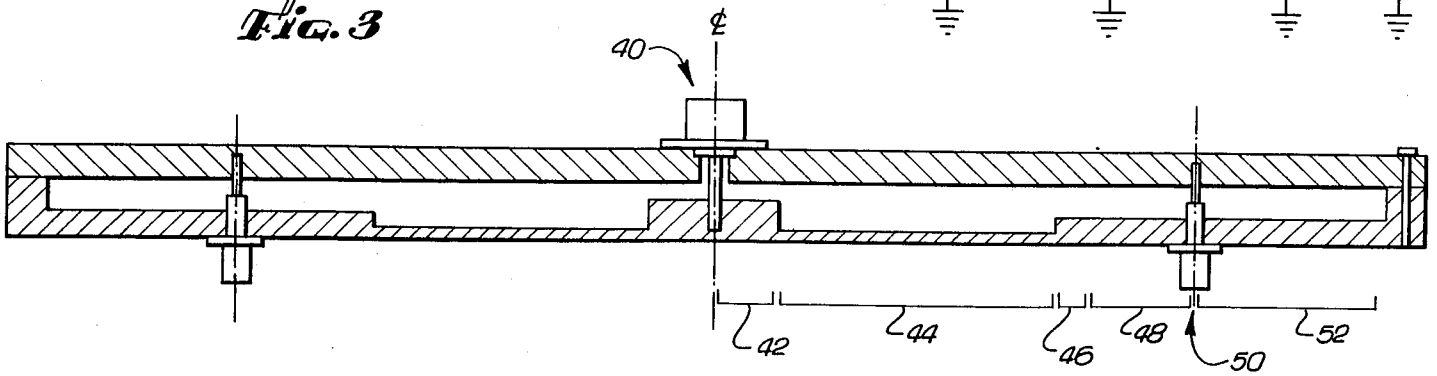
* and FIG. 3 is a cross-sectional view of a divider/combiner constructed in accordance with the invention, taken along a diameter of the device.

FIG. 3 shows the detailed design of a radial waveguide in accordance with the invention. The device shown was configured to provide a passband of 800–1600 megahertz (MHz). The following table gives the inner radius and height of each waveguide section:

| Waveguide Section | Inner radius (inches) | Height (inches) |
|---|---|---|
| 42 | 0.060 | .100 |
| 44 | 0.550 | .625 |
| 46 | 3.860 | .415 |
| 48 | 4.500 | .415 |
| 52 | 5.750 | .415 |
| Outer radius = | 7.900 | |

Note that the heights of waveguide sections 46 and 48 have been made the same. For this illustrative design, the optimized height dimensions of these two sections were so nearly identical that it was expedient to force them to be identical to permit further savings in manufacturing costs.

One measure of the passband performance of a device is the power loss in decibels (dB) over the passband. Another, more sensitive measure is the voltage standing wave ration (VSWR). For the ideal passband, the VSWR has a value of unity. A reasonable goal in the range 1.3–1.5 has been achieved with the invention as described. This corresponds to a loss of about 0.1 dB. Reaching this performance goal may require post-construction "tweaking" in one significant respect. The inductance of the probe 51 depends largely on its diameter, length, and spacing between adjacent probes. Selection of these dimensions may not always afford sufficient control over the inductance 26', and some impedance matching adjustments may have to be made at the output ports 50, to attain the desired performance goal.

Prior to optimization of the waveguide section dimensions, a VSWR of about 2.0 is achievable, corresponding to a loss of about 0.5 dB. Although the latter figure represents a good performance by some standards, it is unacceptable for use as a high-power combiner or divider.

It will be appreciated from the foregoing that the present invention represents a significant advance in the field of microwave divider/combiners for use at high powers and high frequencies. In particular, the invention provides a divider/combiner with a desired broad bandwidth for use at high powers and frequencies. The resulting waveguide hardware has a simple geometry and is therefore convenient to manufacture at relatively low cost. It will also be appreciated that, although an embodiment of the invention has been described in detail for purposes of illustration, various modifications may be made without departing from the spirit and scope of the invention. Accordingly, the invention is not to be limited except as by the appended claims.

We claim:

1. A broadband radial microwave power divider/-combiner, comprising:

a pair of circular, axially spaced waveguide plates having a plurality of adjoining circumferentially-continuous, annular-shaped radial waveguide sections, each of which has a parallel walls formed by the two waveguide plates and has a radial length and axial spacing optimally selected to provide a close equivalent of a desired lumped circuit element;

a central point located at the center of the plates; and a plurality of peripheral ports iniformly spaced about a circular arc near the periphery of the plates;

wherein the equilvalent-circuit values of the annular-shaped radial waveguide sections combine to provide a radial microwave power divider or combiner having a desired wide passband characteristic over a selected frequency range.

2. A broadband radial microwave power divider/-combiner, comprising:

a pair of circular, axially spaced waveguide plates having a plurality of adjoining circumferentially-continuous, annular-shaped radial waveguide sections, each of which has parallel walls formed by the two waveguide plates and has a radial length and axial spacing optimally selected to provide a close equivalent of a desired lumped circuit element;

a central port located at the center of the plates; and a plurality of peripheral ports uniformly spaced about a circular arc near the periphery of the plates;

wherein one of the waveguide plates is planar and the other has a plurality of annular steps in its height, to define the annular-shaped radial waveguide sections;

and wherein the equivalent-circuit values of the annular-shaped radial waveguide sections combine to provide a radial microwave power divider of combiner having a desired wide passband characteristic over a selected frequency range.

3. A broadband radial microwave power divider/-combiner as set forth in claim 1, wherein:

the annular-shaped radial waveguide sections define at least two annular-shaped radial waveguide cavities coupled together serially in a radial sense.

4. A broadband radial microwave power divider/-combiner, comprising:

a pair of circular, axially spaced waveguide plates having a plurality of adjoining circumferentially-continuous, annular-shaped radial waveguide sections, each of which has parallel walls formed by the two waveguide plates and has a radial length and axial spacing optimally selected to provide a close equivalent of a desired lumped circuit element;

a central port located at the center of the plates; and a plurality of peripheral ports uniformly spaced about a circular arc near the periphery of the plates;

wherein the annular-shaped radial waveguide sections include:

a first waveguide section located at the center of the waveguide, and having an equilavent-circuit representation of a shunt capacitance;

a second waveguide section adjoining the first and having an equivalent-circuit representation of series inductance;

a third waveguide section adjoining the second and having an equivalent-circuit representation of another shunt capacitance;

a fourth waveguide section adjoining the third and extending out to the peripheral ports, and having the equivalent-circuit representation of another series inductance; and a fifth waveguide section extending beyond the peripheral ports and terminating in an annular endwall, and having the equivalent-circuit representation of a shunt inductance;

and wherein the equivalent-circuit values of the annular-shaped radial waveguide sections combine to provide a radial microwave power divider or combiner having a desired wide passband characteristic over a selected frequency range.

5. A method of designing a broadband radial microwave power divider/combiner, comprising the steps of:

first designing a lumped-parameter filter to provide a desired frequency response between a single input port and a plurality of output ports;

then selecting the radial length and axial spacing of the plates in circumferentially-continuous, annular-shaped radial a waveguide section, to provide an approximate radial waveguide equivalent of each lumped circuit parameter of the filter design; and then optimizing the selected dimensions of the annular-shaped radial waveguide sections to approach as closely as possible the desired response characteristics.

* * * * *